US008471768B2

(12) United States Patent
Wang et al.

(10) Patent No.: US 8,471,768 B2
(45) Date of Patent: Jun. 25, 2013

(54) METHOD AND APPARATUS FOR AN ANTENNA

(75) Inventors: Hanyang Wang, Abingdon (GB); Pekka Halme, Espoo (FI); Michael Holland, Fleet (GB); Ali Mehmed, London (GB); Ming Zheng, Farnborough (GB); Alan Johnson, Frimley (GB); Weiwen Liu, Woking (GB); Catherine Islip, Farnborough (GB); Niels B. Larsen, Kgs Lyngby (DK)

(73) Assignee: Nokia Corporation, Espoo (FI)

( * ) Notice: Subject to any disclaimer, the term of this patent is extended or adjusted under 35 U.S.C. 154(b) by 745 days.

(21) Appl. No.: 12/655,134

(22) Filed: Dec. 22, 2009

(65) Prior Publication Data

US 2011/0148718 A1 Jun. 23, 2011

(51) Int. Cl.
*H01Q 1/38* (2006.01)
*H01Q 7/00* (2006.01)

(52) U.S. Cl.
USPC ..... 343/700 MS; 343/702; 343/745; 343/866

(58) Field of Classification Search
USPC ..... 343/700 MS, 702, 741, 744, 745, 343/749, 866
See application file for complete search history.

(56) References Cited

U.S. PATENT DOCUMENTS

| | | | | |
|---|---|---|---|---|
| 3,736,591 | A | 5/1973 | Rennels et al. | 343/702 |
| 4,814,776 | A | 3/1989 | Caci et al. | 343/702 |
| 5,264,735 | A * | 11/1993 | Riebman | 327/366 |
| 6,028,559 | A | 2/2000 | Satoh et al. | 343/744 |
| 6,515,625 | B1 | 2/2003 | Johnson | 343/700 MS |
| 6,873,299 | B2 * | 3/2005 | Dakeya et al. | 343/745 |
| 7,307,494 | B2 * | 12/2007 | Erb | 333/126 |
| 2002/0105474 | A1 * | 8/2002 | Kitamura et al. | 343/850 |
| 2003/0098813 | A1 | 5/2003 | Koskiniemi et al. | 343/702 |
| 2008/0018541 | A1 | 1/2008 | Pang et al. | 343/702 |

FOREIGN PATENT DOCUMENTS

| | | | |
|---|---|---|---|
| EP | 2 065 969 | A1 | 6/2009 |
| JP | 10-028013 | A | 1/1998 |
| JP | 2006-197329 | A | 7/2006 |
| JP | 2008301241 | A | 12/2008 |
| WO | WO-2009/070100 | A1 | 6/2006 |
| WO | WO-2008/078144 | A1 | 7/2008 |
| WO | WO-2008/115117 | A1 | 9/2008 |
| WO | WO-2009/051433 | A1 | 4/2009 |

OTHER PUBLICATIONS

Lee, "A Compact and Low-Profile Tunable Loop Antenna Integrated With Inductors", IEEE Antennas and Wireless Propagation Letters, vol. 7, (2008), (pp. 621-624).

(Continued)

*Primary Examiner* — Tan Ho
(74) *Attorney, Agent, or Firm* — Harrington & Smith

(57) ABSTRACT

In accordance with one example embodiment of the present invention an apparatus is disclosed. The apparatus includes a cover, a ground plane, a first inductor, and a second inductor. The cover includes a first end and an opposite second end. The cover is configured to operate as a first loop radiator portion. The ground plane is proximate the cover. The ground plane is configured to operate as a second loop radiator portion. The first inductor is proximate the first end of the cover. The second inductor is between the second end of the cover and the ground plane. The cover, the ground plane, the first inductor, and the second inductor are configured to provide a loop radiator.

18 Claims, 11 Drawing Sheets

OTHER PUBLICATIONS

"Nokia N79 User Guide", p. 17, 2008 (and picture of inside cover), 2 pgs.
"Nokia N78 User Guide", p. 15, 2008 (and picture of inside cover), 2 pgs.
"XtremeMac", Jan. 2005 press release, (http://www.xtrememac.com/press/pr/2005_01_11b.php), 2 pgs.
"Griffin Technology", Sep. 2008 press release, (http://www.griffintechnology.com/press/releases/61), 1 pg.

* cited by examiner

90

| FREQUENCY (MHz) | 76 | 92 | 108 |
|---|---|---|---|
| L1=10nH; no L4 | −69.75 dBi | −66.18 dBi | −63.17 dBi |
| L1=10nH; L4=1.0nH | −69.51 dBi | −65.90 dBi | −62.82 dBi |
| L1=10nH; L4=10nH | −67.26 dBi | −62.89 dBi | −58.96 dBi |
| L1=10nH; L4=18nH | −64.53 dBi | −59.51 dBi | −54.91 dBi |
| L1=10nH; L4=28nH | −61.41 dBi | −55.87 dBi | −50.87 dBi |

METHOD AND APPARATUS FOR AN ANTENNA

TECHNICAL FIELD

The present application relates generally to an antenna and, more particularly, to a loop e-field antenna for an apparatus.

BACKGROUND

As consumers demand increased functionality from electronic devices, there is a need to provide improved devices having increased capabilities while maintaining robust and reliable product configurations. One general trend in the electronic device industry is to provide FM antenna capabilities. These single feature devices generally comprise frequency modulation transmission (FMTx) antennas having a spiral monopole antenna or wire monopole antenna.

In addition, various devices provide for FMTx implementation into mobile handsets having non-conductive housings. These devices generally comprise an FMTx antenna with either a full loop, or half loop configuration. The full/half loop antenna configuration is generally located on (or integrated with) a portion of the device housing. As the frequency band of the FMTx is far below other cellular and non-cellular bands (76-108 MHz), an FMTx antenna generally requires much longer length than any other handset antennas. For example, for the GSM900 band, the antenna length is about a quarter wavelength that is about 80-90 mm, whereas the FMTx antenna's is about 10 times longer, namely about 800-900 mm.

SUMMARY

Various aspects of examples of the invention are set out in the claims.

According to a first aspect of the present invention, an apparatus is disclosed. The apparatus includes a cover, a ground plane, a first inductor, and a second inductor. The cover includes a first end and an opposite second end. The cover is configured to operate as a first loop radiator portion. The ground plane is proximate the cover. The ground plane is configured to operate as a second loop radiator portion. The first inductor is proximate the first end of the cover. The second inductor is between the second end of the cover and the ground plane. The cover, the ground plane, the first inductor, and the second inductor are configured to provide a loop radiator.

According to a second aspect of the present invention, an apparatus is disclosed. The apparatus includes a first conductive portion, a second conductive portion, and at least two tuning inductors. The first conductive portion includes a first end, a second end, and a first length between the first end and the second end. The first conductive portion further includes at least a portion of a loop antenna structure. The second conductive portion includes a first end, a second end, and a second length between the first end and the second end of the second conductive portion. The portion of the loop antenna structure is connected between the at least two tuning inductors. The at least two tuning inductors are configured to move an electrical field along the first length and/or the second length.

According to a third aspect of the present invention, a method is disclosed. A cover having a first end and an opposite second end is provided. Transmitter and/or receiver circuitry is provided to the cover. The cover is configured to operate as a first loop radiator portion. A ground plane is provided proximate the cover. The ground plane is configured to operate as a second loop radiator portion. A first inductor is provided proximate the first end of the cover. A second inductor is provided between the second end of the cover and the ground plane. The cover, the ground plane, the first inductor, and the second inductor are configured to provide a loop radiator.

According to a fourth aspect of the present invention, a method is disclosed. A first conductive portion is provided. The first conductive portion includes a first end, a second end, and a first length between the first end and the second end. Electronic circuitry is provided to the first conductive portion. A second conductive portion is provided. The second conductive portion includes a first end, a second end, and a second length between the first end and the second end of the second conductive portion. At least two tuning inductors are provided. The at least two tuning inductors are configured to move an electrical field along the first length and/or the second length.

BRIEF DESCRIPTION OF THE DRAWINGS

For a more complete understanding of example embodiments of the present invention, reference is now made to the following descriptions taken in connection with the accompanying drawings in which.

DETAILED DESCRIPTION OF THE DRAWINGS

An example embodiment of the present invention and its potential advantages are understood by referring to FIGS. 1 through 13 of the drawings.

Figure 1:
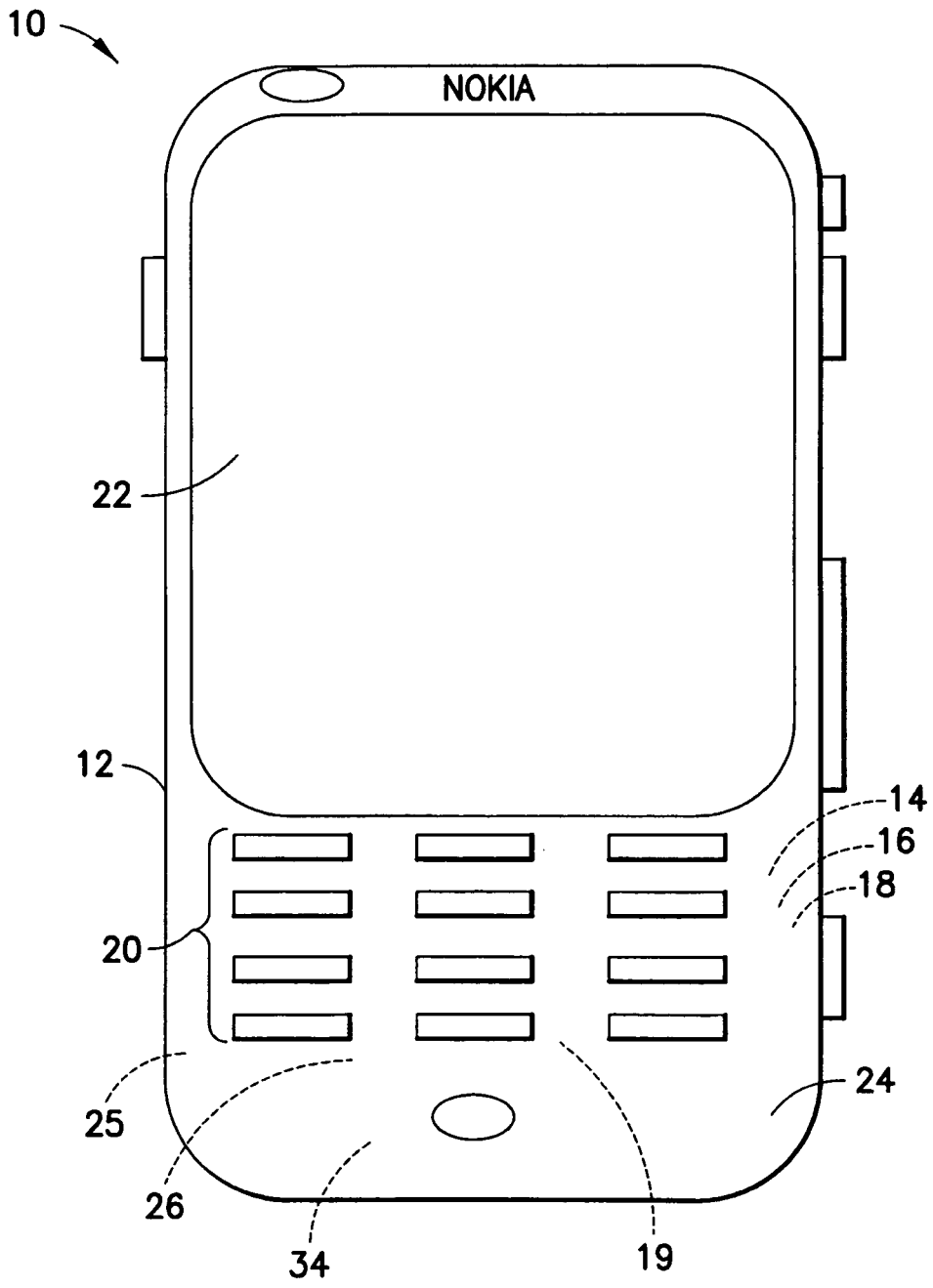
FIG. 1 is front view of an apparatus incorporating features of the invention.

Referring to FIG. 1, there is shown a front view of an electronic device 10 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

According to one example of the invention the device 10 is a multi-function portable electronic device. However, in alternate embodiments, features of the various embodiments of the invention could be used in any suitable type of portable electronic device such as a mobile phone, a gaming device, a music player, a notebook computer, or a PDA, for example. In addition, as is known in the art, the device 10 can include multiple features or applications such as a camera, a music player, a game player, or an Internet browser, for example. The device 10 generally comprises a housing 12, a transceiver 14 connected to an antenna 16, electronic circuitry 18, such as a controller and a memory for example, within the housing 12, a battery 19, a user input region 20, and a display 22. The display 22 could also form a user input section, such as a touch screen. It should be noted that in alternate embodiments, the device 10 can have any suitable type of features as known in the art.

Figure 2:
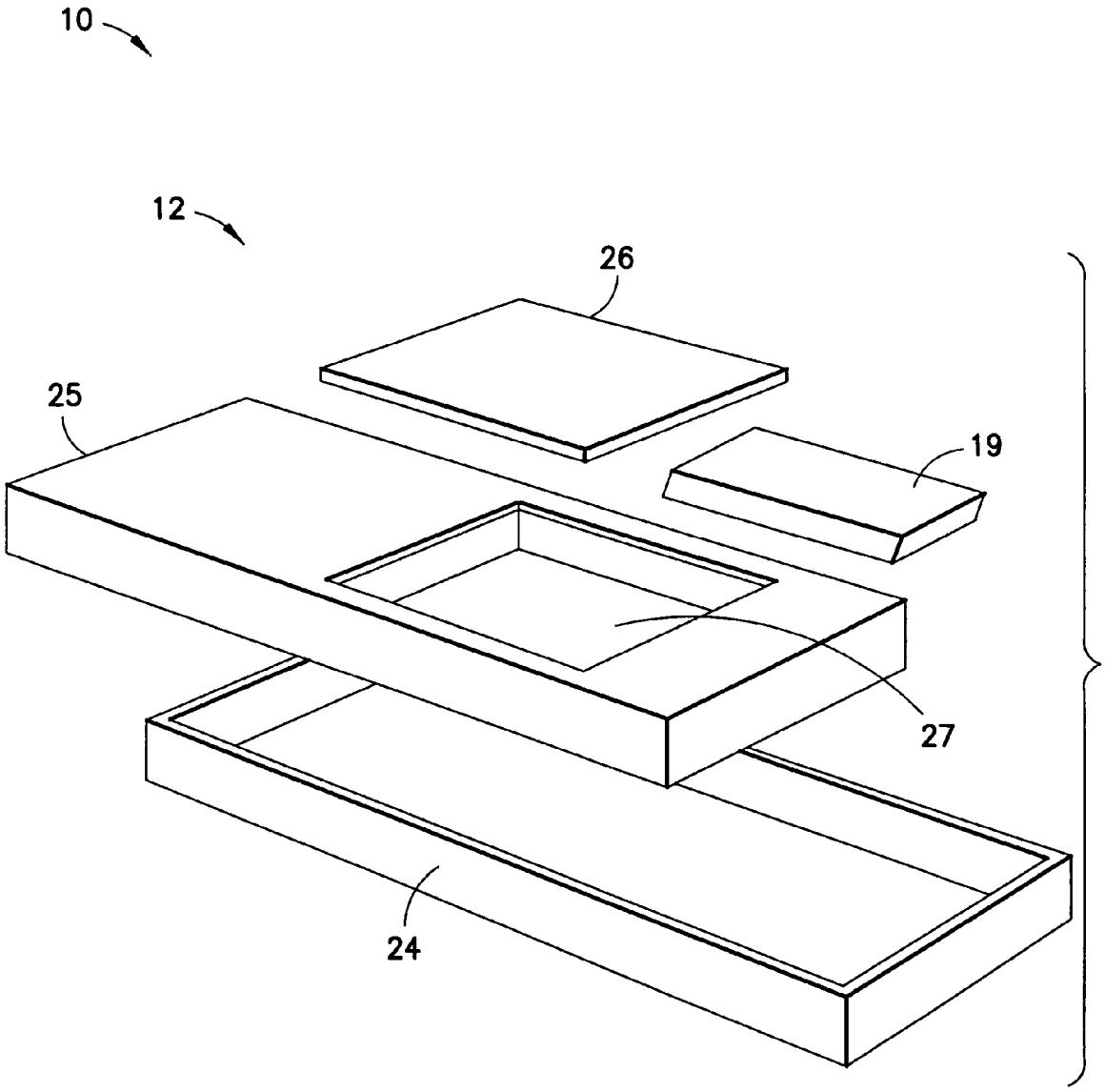
FIG. 2 is an exploded perspective view of a housing of the apparatus shown in FIG. 1.

The housing 12 comprises a front housing section 24, a first rear housing section 25, and a second rear housing section 26 (see FIG. 2). In the example embodiment shown in FIG. 2, the first rear housing section 25 may form a portion of the rear outer surface of the device 10 and the second rear housing section 26 may form another portion of the rear outer surface of the device 10. In another example embodiment, the second rear housing section, or rear cover, 26 may comprise a greater portion, or all, of the rear outer surface of the device 10. In yet another example embodiment, the rear cover 26 may form the rear outer surface and side surfaces of the device 10. However, any suitable configuration for the rear cover may be provided. Equally, the front housing section, or front cover, 24 may form the front outer surface and side surfaces of the device. In alternate embodiments, the front cover may comprise only a portion, or all, of the front outer surface of the device. However, any suitable configuration for the front cover 24 may be provided.

Figure 3:
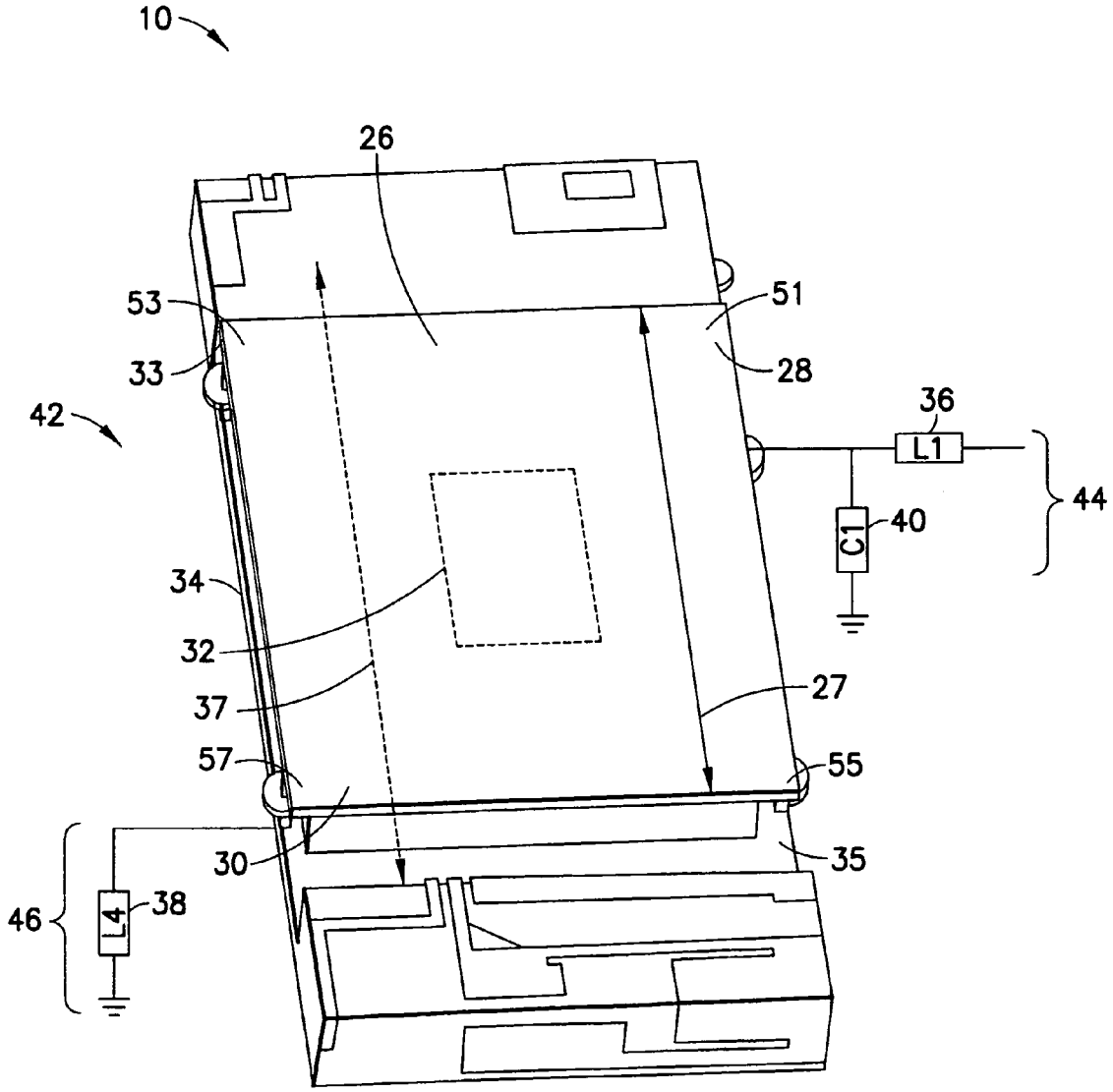
FIG. 3 is a perspective partial section view of the apparatus shown in FIG. 1.

According to one example embodiment and referring now to FIG. 3, a partial section view of the device 10 is shown. The rear cover 26 may be formed, at least partially, from a conductive material such as metal, for example. However, any suitable material for the rear cover may be provided. The rear cover (or first conductive portion) 26 comprises a first end 28 and a second end 30, wherein a first corner 51 and a second corner 53 of the rear cover 26 are at the first end 28, and a third corner 55 and a fourth corner 57 of the rear cover 26 are at the second end 30. According to some example embodiments of the invention, FMTx circuitry may be between the first end 28 and the second end 30. However, any suitable configuration wherein the rear cover 26 is configured to operate as an antenna radiator may be provided. According to some embodiments of the invention, the FMTx circuitry may be integrally formed with the rear cover 26, or the FMTx circuitry may be disposed on a second conductive portion 34, which may for example be a multilayer printed wiring board (PWB). According to some alternate embodiments of the invention, the FMTx antenna may be fixedly disposed to an interior surface 32 of the rear cover 26, for example the FMTx antenna may comprise a flexible circuit attached to the interior surface 32 of the rear cover 26, or the FMTx antenna may comprise a sheet metal part attached, for example, by a heat staking process to the interior surface 32 of the rear cover 26. However, these are merely provided as non-limiting examples and it should be noted that any suitable configuration for providing the rear cover as a loop radiator may be provided. According to some alternate embodiments the front cover 24, or any other cover of the device, may be used as an alternative to using the rear cover 26.

As mentioned above, the device 10 further comprises a second conductive portion 34, a first inductor 36, a second inductor 38, and an RF component 40. The second conductive portion (which may be a printed circuit board [PCB] or printed wiring board [PWB] of the device, for example) 34 is provided in the housing between the rear cover 26 and the front housing section or front cover 24. The PWB 34 may comprise one or more layers, wherein at least one layer may provide a radio frequency (RF) ground plane for the apparatus. The PWB 34 comprises a first end 33 and a second end 35. According to various embodiments of the invention the rear cover 26 may be a conductive cover which acts as the FMTx antenna, in particular the rear cover 26 of the portable electronic device 10 (which is itself electrically short at 100 MHz) is utilized in conjunction with the printed wiring board, or ground plane, 34 (which is also electrically short) to form what is a planar loop antenna (with a predominant e-field). The conductive rear cover 26 in this example may in addition function as a removeable battery compartment cover for enclosing the battery 19 and battery compartment 27 of the device when access is to the battery 19 is not required, and removed from the device when access to the battery 29 is required (see FIG. 2).

It should be noted that although the first and second conductive portions are provided as the rear cover and the printed wiring board 34 in the embodiment described above, alternate embodiments may provide any other suitable device components for the first and second conductive portions, for example conductive display frames or supports, conductive battery covers or housings, conductive battery anodes or cathodes, conductive microwave shielding parts, etc.

The inductors 36, 38 may be lumped components, or microstrip components, or any other suitable alternative microwave components as known in the art. Additionally, in this embodiment the RF component 40 may be a capacitor. However, in alternate embodiments, the RF component may comprise any suitable type of component or any combination of components in parallel and series as is known in the art. The RF component 40 may therefore be expanded to a collection of components forming a radio frequency circuit network topology. Network topologies as known in the art may be, and are not limited to, Pi-networks, T-networks, and L-networks, and may be combined into more complex network topologies. As can be seen from FIG. 3, the inductor 36 (and capacitor 40) and the inductor 38 are introduced at opposite corners of the conductive cover 26 to improve the performance of the FMTx antenna 42.

Figures 4, 5:
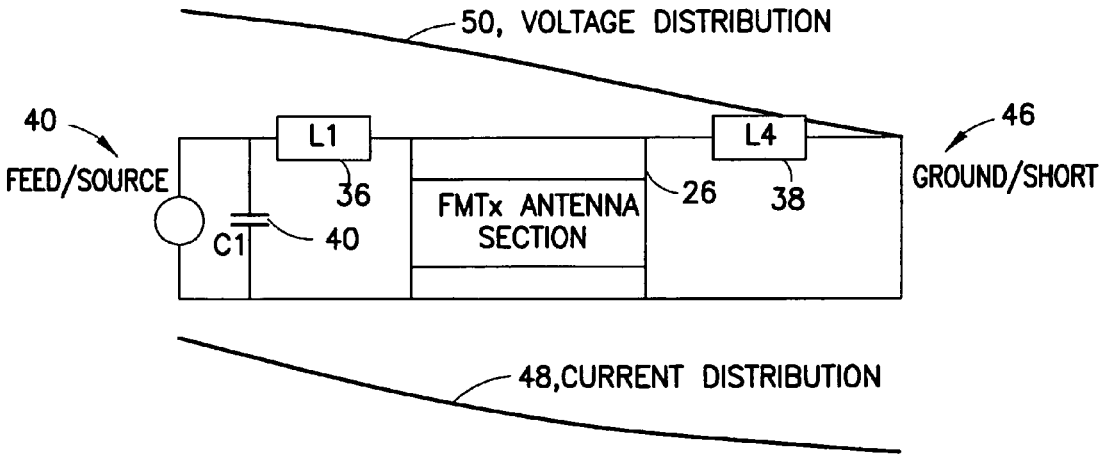
FIG. 4 is a schematic diagram of an equivalent transmission line circuit of a conductive cover FMTX antenna used in the device shown in FIG. 1.
FIG. 5 is a table including simulated radiation efficiency for a conductive cover FMTX antenna used in the device shown in FIG. 1.

According to one embodiment, the FMTx antenna comprises a feed pin and a ground pin located proximate the diagonal corners 21, 57 of the rear cover 26. The inductor 36 and the capacitor 40 are at the feed pin side 44 and the inductor 38 is at the ground pin side 46. The capacitor 40 (which may be a shunt capacitor, for example) and the series inductor 36 at the feed side may be used to tune the FMTx antenna 42. As illustrated in FIG. 4, the antenna 42 is a whole loop comprising the cover 26, the PWB 34, and the components which effectively increase the electrical length of the otherwise electrically short cover and PWB at FM frequencies and can be equivalent to a section of a shorted transmission line (of the conductive cover FMTx antenna). For example, the whole combination of the cover 26, the PWB 34, and the components 36, 38, 40 create a full wavelength loop antenna in terms of the electrical length of the whole structure. The feed side 44 is the source, while the ground side 46 is the short circuit. The total electrical length of the equivalent transmission line is less than a quarter of a wavelength at the operating frequency. Based on transmission line theory, at the short circuit end, the electrical current distribution has a maximum value while the voltage distribution has a minimum value, which is illustrated by the curves 48, 50 respectively (see FIG. 4). The conductive cover FMTx antenna is located at an adequate distance from the short circuit end 46 such that the electric field (voltage distribution) is stronger and magnetic field (current distribution) is weaker than the respective electric and magnetic fields at the short circuit end 46. The conductive cover FMTx antenna 42 is an electrically oriented antenna as it concentrates electrical field due to its wide conductive plate 26 and the small gap with the battery 29 and PWB 34. Such a wide conductive plate may be considered to be planar. For such an electrically oriented antenna, the location of the antenna at the equivalent transmission line is proximate the high electrical field section. The technical effects of any one or more of the exemplary embodiments provide for improved radiation performance by disposing the antenna proximate the high electrical field section, rather than high magnetic field section, in order to concentrate the electrical field and radiate more efficiently.

Still referring to FIGS. 3, 4, the inductors 36, 38 are provided at the antenna in a series configuration. The first (matching/tuning) inductor 36 is at the feed or first ends 28, 33 of the rear cover 26 and ground plane 34. The second (matching/tuning) inductor 38 is placed between the second end 30 of the rear cover 26 and the second end 35 of the ground plane 34. The inductor 38 can move the FMTx antenna electrically from the high current area (magnetic field) to high voltage field (electrical field) area. This split inductor technique allows the maximum e-field (voltage distribution) to be physically distributed along the rear cover (for example along a length 27 of the rear cover 26, or along a length 37 of the PWB 34), thus providing improved radiation efficiency. According to various exemplary embodiments of the invention, one set of criteria for choosing the inductor 36, 38 values may include: 1) Satisfactory tuning range of the FMTx antenna. 2) The conductive cover FMTx antenna is located at the high voltage section in the equivalent transmission line. 3) There is no electrostatic discharge (ESD) problem.

Referring now also to FIG. 5, a table 90 with simulated radiation efficiency of the conductive cover FMTx antenna is shown. It should be noted that any suitable simulator may be utilized for simulating radiation efficiency, such as CST 3D Microwave Studio, for example. As shown in FIG. 5, a larger value for the inductor (L4) 38, while maintaining a constant value for the inductor (L1) 36, provides an improved antenna radiation efficiency. However, it should be noted that, according to some embodiments of the invention, ESD protection may be a consideration when choosing the value of the inductor (L4) 38.

Figure 6:
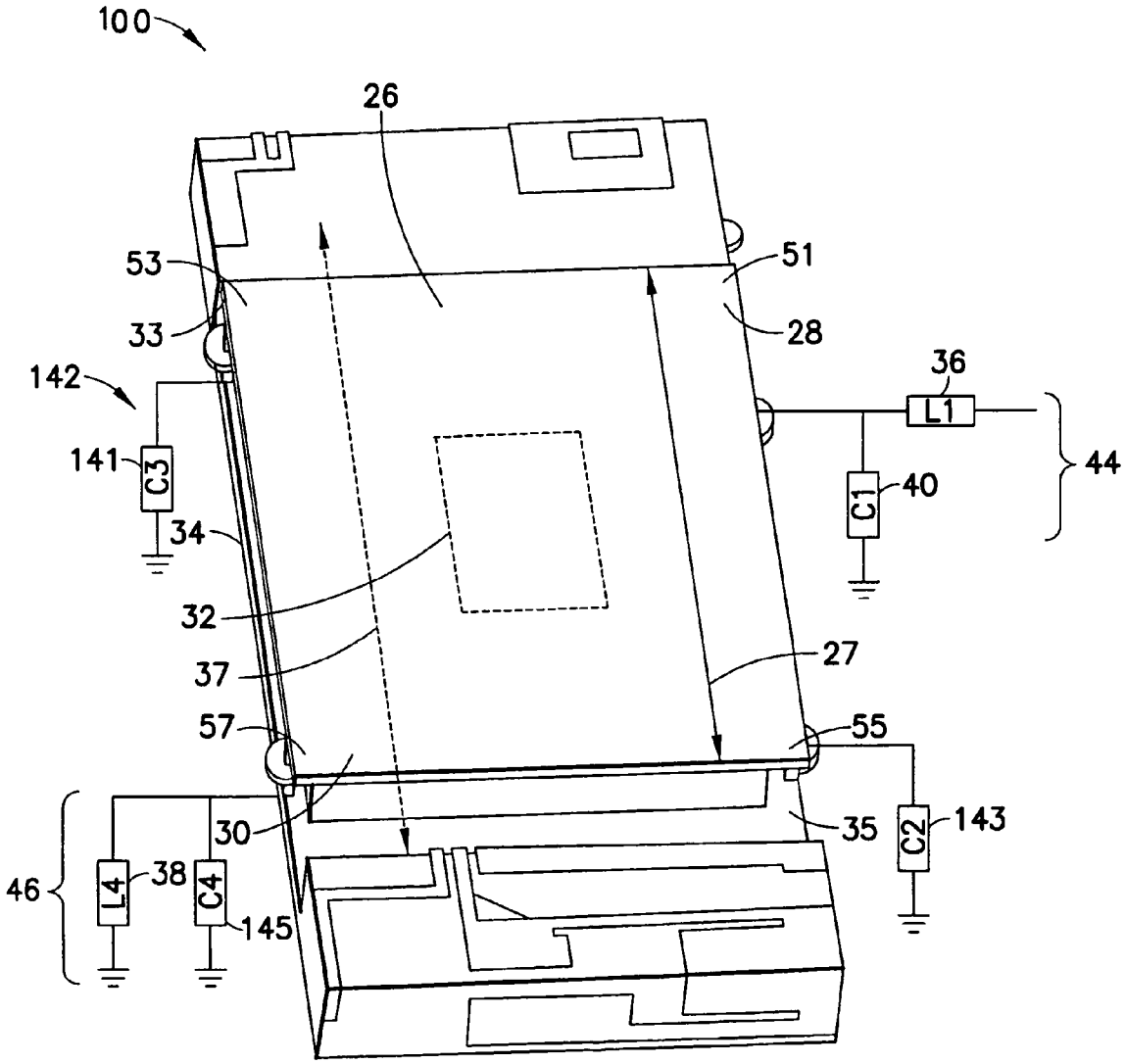
FIG. 6 is a perspective partial section view of an apparatus in accordance with another embodiment of the invention.

Referring now also to FIG. 6, there is shown a device 100 in accordance with another example embodiment of the invention. The device 100 is similar to the device 10 and similar features are similarly numbered. For example, similar to the device 10, the device 100 comprises a rear cover 26 having FMTx circuitry, a PWB (or ground plane) 34, a first inductor 36, a second inductor 38, and an RF component 40. Also similar to the device 10, the inductor 36 and the capacitor 40 are at the feed pin side 44 (proximate the corner 51), and the inductor 38 is at the ground pin side 46 (proximate the corner 57). This provides for the two inductors 36, 38, to be placed at either end of the planar loop and to be configured for shifting the e-field distribution along the radiator (for example, either the rear cover 26 or the ground plane 34) structure. One difference between the device 100 and the device 10 is that the device 100 comprises additional RF components 141, 143, 145 displaced between the first conductive portion 26 and the second conductive portion 34 for filtering frequencies outside of the operating frequency of the loop antenna 142 (for example, cellular frequencies). As can be seen from FIGS. 6, 7, the inductors 36, 38 and the capacitors 40, 141, 143, 145 are introduced at the four corners 51, 53, 55, 57 of the conductive cover 26 to further improve the performance of the FMTx antenna 142.

The technical effects of any one or more of the exemplary embodiments of the invention provide for reducing or eliminating unwanted resonance within cellular and non-cellular bands. As the size of the conductive cover is comparable to cellular and non-cellular antennas, there possibly exist a number of higher order modes within cellular and non-cellular bands. These unwanted higher order modes could have strong coupling and interactions with the other antennas, which could deteriorate the antennas' radiation efficiency and the isolation between the antennas.

Figure 7:
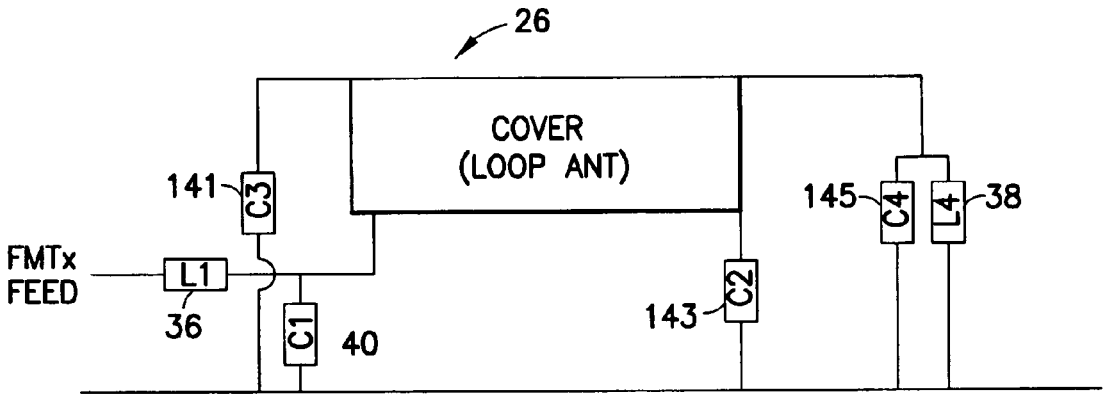
FIG. 7 is a schematic diagram of the apparatus shown in FIG. 6.

For example, in the embodiment shown in FIGS. 6, 7, the conductive cover 26 may be grounded at least at the four corners 51, 53, 55, 57 of the cover to prevent the conductive cover resonating at cellular and non-cellular bands and/or to increase the resonant frequency of the higher order resonance modes so as to move the unwanted resonance away from cellular and non-cellular bands. However, it should be noted that if the four grounded points are provided in the FMTx antenna, the current of the FMTx antenna may generally take the shortest path. For the example, if the conductive cover 26 is directly grounded at the top left corner (proximate the capacitor 141), bottom right corner (proximate the capacitor 143) and bottom left corner (proximate the capacitor 145 and the inductor 38), the current takes the shorter path from the top right feed (proximate the capacitor 40 and the inductor 36) to the top left corner or from the top right feed to the bottom right ground, while the longest path is the diagonal line from the top right feed to the bottom left ground. This may, for example, significantly reduce the antenna's radiation efficiency as the FMTx antenna has a much shorter electrical length. This reduced efficiency may be alleviated by introducing the series capacitor 141, 143, 145 at each of the corners as shown in FIGS. 6, 7. Each of the capacitors behaves as a high pass filter: at the cellular and non-cellular bands, the corners are grounded (short circuit); at the FMTx band the corners are floated (open circuit). Consequently, the current of the FMTx antenna generally takes the diagonal path from the top right feed to the bottom left ground, while the conductive cover is grounded at these corners for the cellular and non-cellular bands.

Still referring to FIG. 7, it should be noted that the loop antenna may be a very electrically short radiator which uses filtering between the loop cover and the ground. In this example embodiment, the inductor 36 and the capacitor 40 may be configured as matching/tuning components proximate the first ends 28, 33, the capacitor 141 may be configured as a high pass filter (HPF) proximate the first ends 28, 33 (with a low impedance at cellular frequencies), the inductor 38 and the capacitor 145 may be configured as matching/tuning components proximate the second ends 30, 35, and the capacitor 143 may be configured as a high pass filter (HPF) proximate the second ends 30, 35 (with a low impedance at cellular frequencies). However, any suitable configuration or orientation may be provided.

Figure 8:
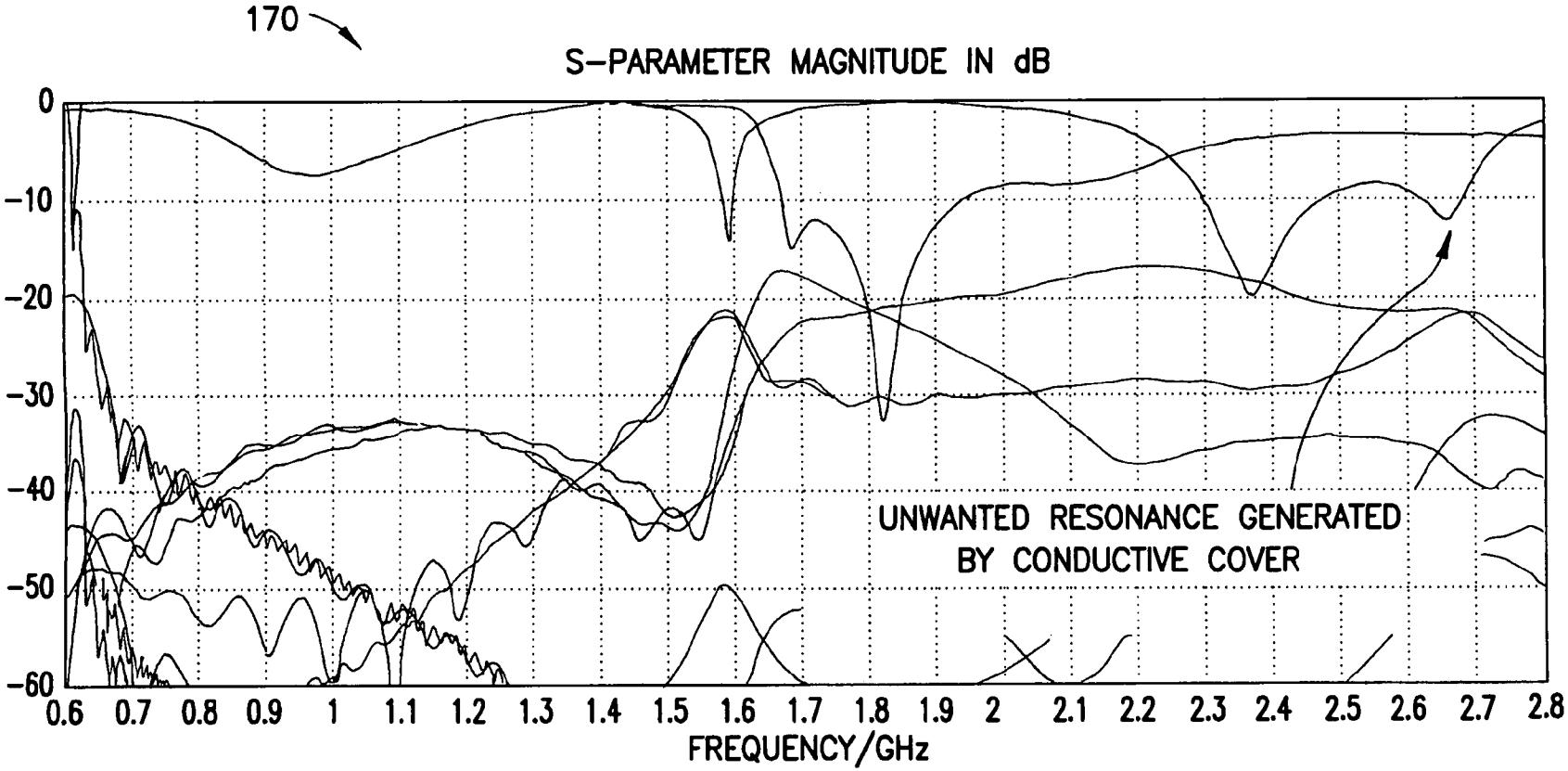
FIGS. 8 and 9 are graphical illustrations for simulated S-parameters relating to the apparatus shown in FIG. 6.
Figure 9:
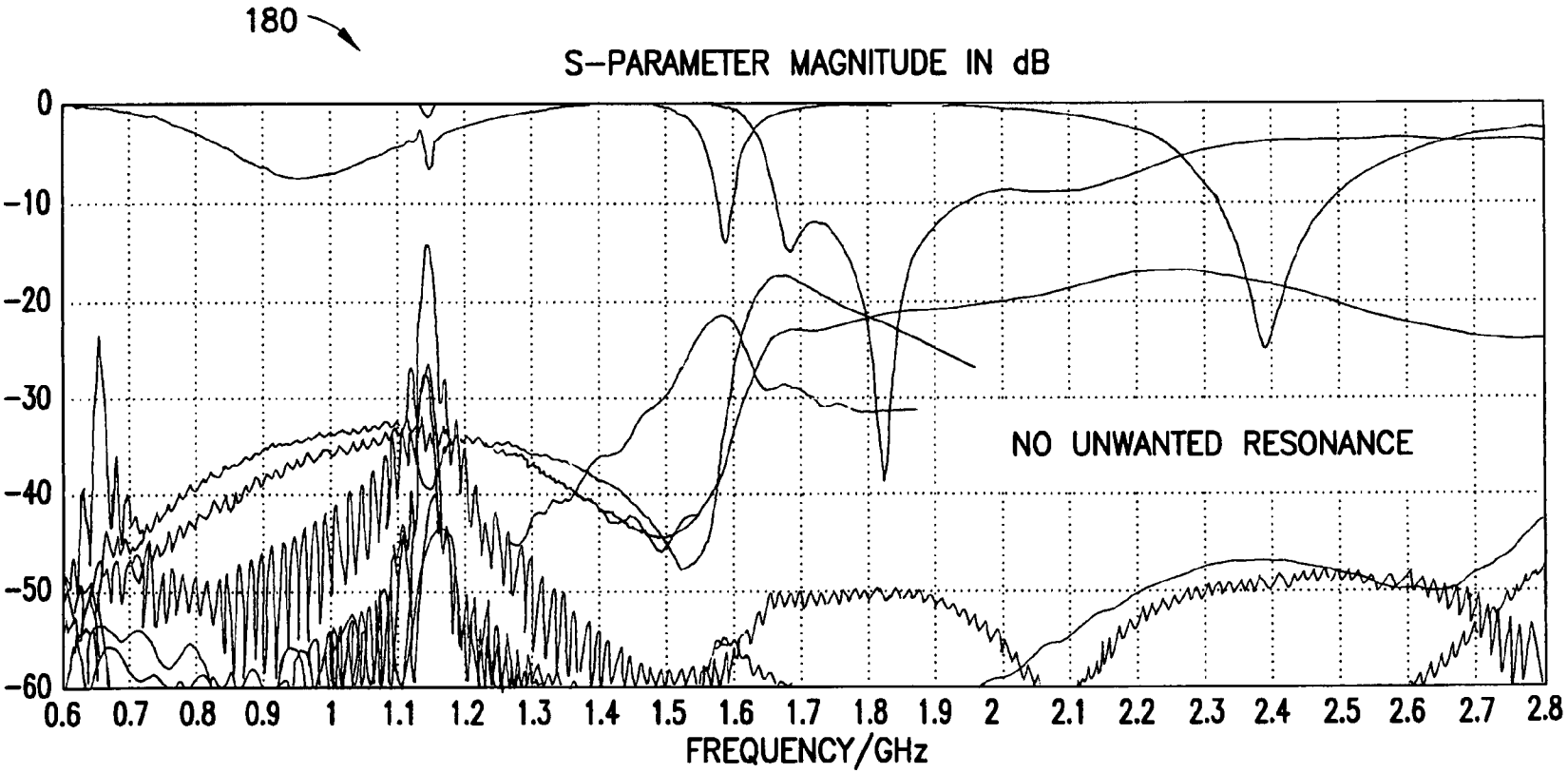

Referring now also to FIGS. 8, 9 there are shown graphical representations 170, 180 illustrating one example of how to tune the unwanted resonance away from BT/WLAN band by using the high pass filter. S-parameters of the embodiment shown in FIGS. 6, 7 have been simulated. In the simulation, Port 1 is the cellular antenna, Port 2 is the GPS antenna, Port 3 is the BT/WLAN antenna and Port 4 is the FMTx antenna. FIG. 8 shows the simulated S-parameters for a device with one ground pin only (for example the bottom left ground pin). With reference to FIG. 8, it can be observed that there is an unwanted resonance near BT/WLAN band. According to some embodiments, in order to tune the unwanted resonance away from the band, two additional grounding pins with a series capacitor 143, 141 (C2=C3=10 pf) may be introduced. The simulated S parameters are given in FIG. 9, in which there is no unwanted resonance within the BT/WLAN band. However, it should be noted that in some example embodiments, the unwanted resonance may be minimized/reduced rather than removed altogether. The FMTx antenna's radiation efficiency has also been simulated, and it has been found that there is virtually no radiation efficiency reduction after introducing the two ground pins with the capacitor.

Figure 10:
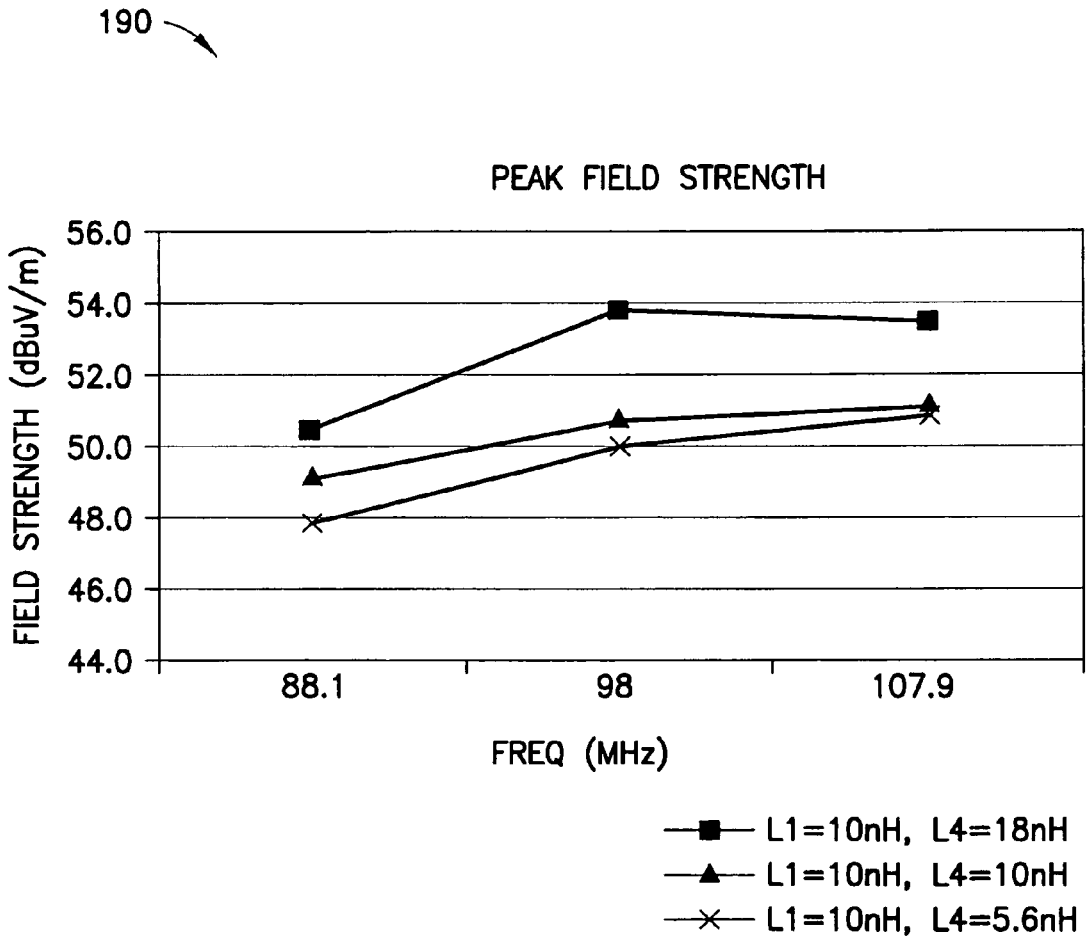
FIG. 10 is a graphical illustration for a measured peak field strength.

Referring now also to FIG. 10, there is shown a graphical representation 190 illustrating measured peak field strength of the FMTx antenna based on measured results. The technical effects of any one or more of the exemplary embodiments of the invention provide for improved performance over conventional configurations. Also, the effect of the L4 inductor 38 value to the radiated peak field strength can be seen in the measured results.

Various embodiments of the invention relate to antennas and more specifically to the design of low frequency antennas operating around 100 MHz (FM) and displaced within a small (relative to a wavelength of the operating frequency) portable electronic device. Some example embodiments provide for FMTx (transmit) but alternate embodiments may apply for other low frequency antennas.

Figure 11:
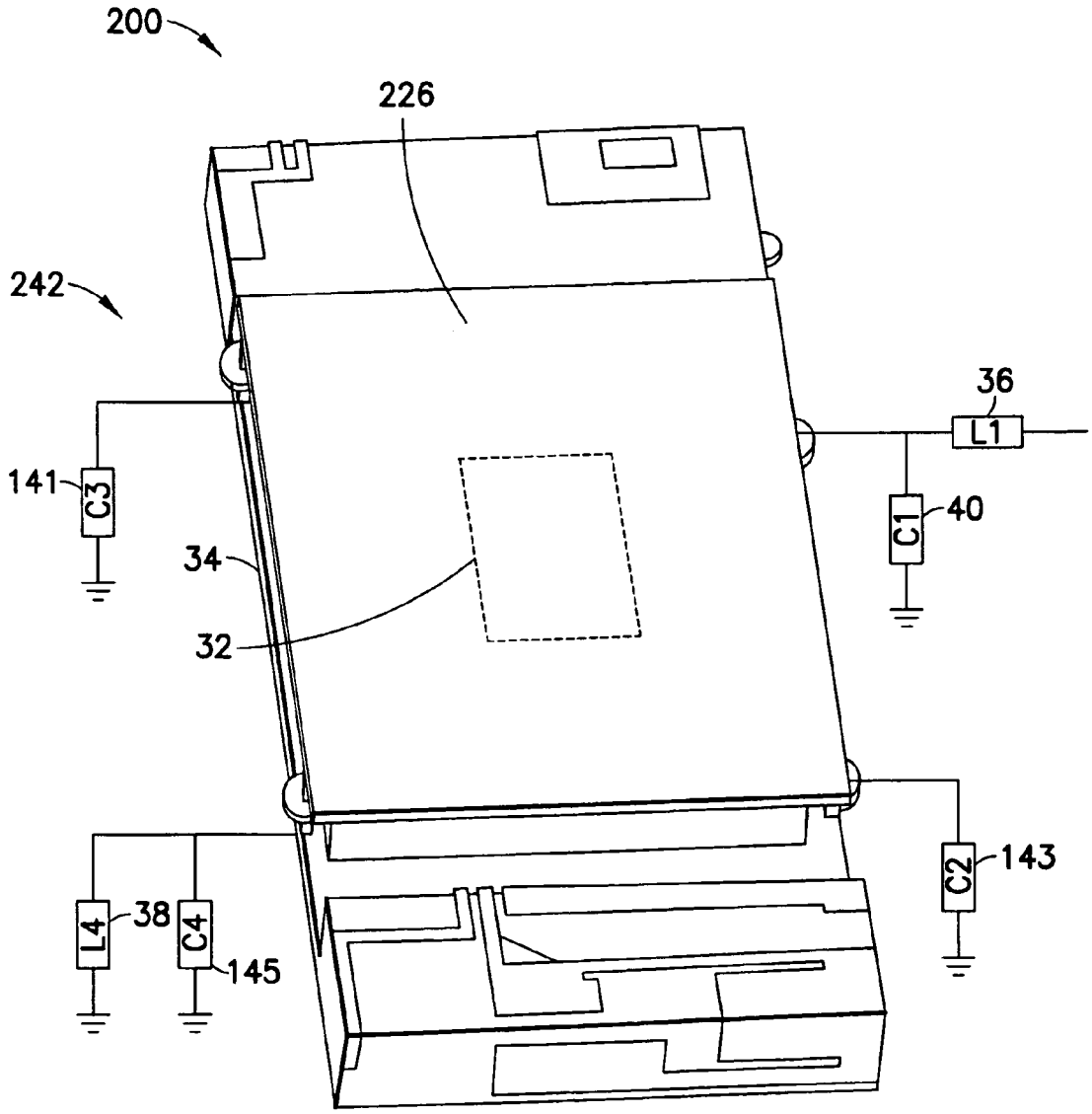
FIG. 11 is a perspective partial section view of an apparatus in accordance with another embodiment of the invention.

For example, referring now also to FIG. 11, there is shown a device 200 in accordance with another embodiment of the invention. The device 200 is similar to the device 100 and similar features are similarly numbered. For example, similar to the device 100, the device 200 comprises a PWB 34, inductors 36, 38, and RF components 40, 141, 143, 145. However, the device 200 comprises a rear cover 226 having FMRx (Receive or broadcast FM) circuitry, wherein the cover 226, the PWB 34, the inductors 36, 38, and the capacitors 40, 141, 143, 145 form an FMRx antenna 242.

Additionally it should be noted that additional alternate embodiments of the invention could be provided for other antennas utilized for sub-500 MHz operation, for example, the lower end of the band for DVB-H. Furthermore, other alternate embodiments may be applied to any other antennas, whose size is small and very capacitive.

Figure 12:
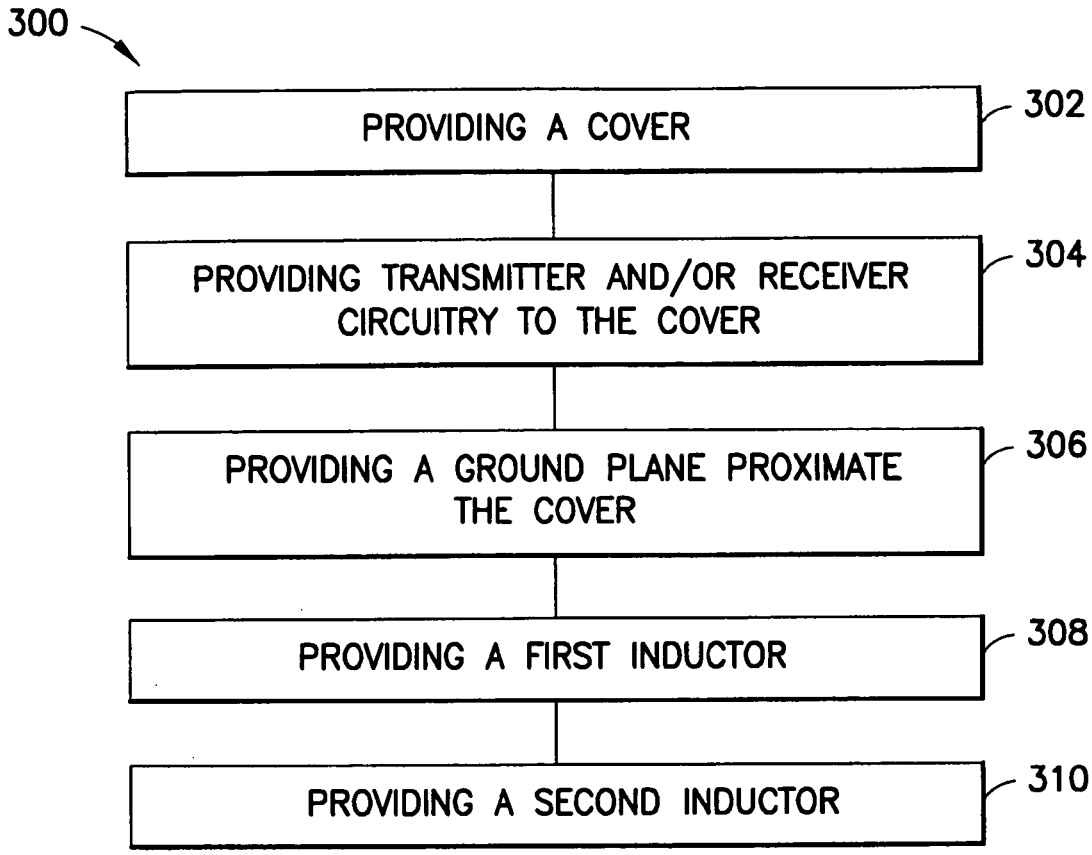
FIG. 12 is a block diagram of an exemplary method.

FIG. 12 illustrates a method 300. The method 300 includes providing a cover having a first end and an opposite second end (at block 302). Providing transmitter and/or receiver circuitry to the cover, wherein the cover is configured to operate as a first loop radiator portion (at block 304). Providing a ground plane proximate the cover, wherein the ground plane is configured to operate as a second loop radiator portion (at block 306). Providing a first inductor proximate the first end of the cover (at block 308). Providing a second inductor between the second end of the cover and the ground plane (at block 310). The method includes providing the cover, the ground plane, and the first and second inductors, wherein the cover, the ground plane and the first and second inductors are configured to provide a loop radiator (wherein, for example, may be a full wavelength loop radiator which makes up the full wavelength electrical length of the entire antenna solution). It should be noted that the illustration of a particular order of the blocks does not necessarily imply that there is a required or preferred order for the blocks and the order and arrangement of the blocks may be varied. Furthermore it may be possible for some blocks to be omitted.

Figure 13:
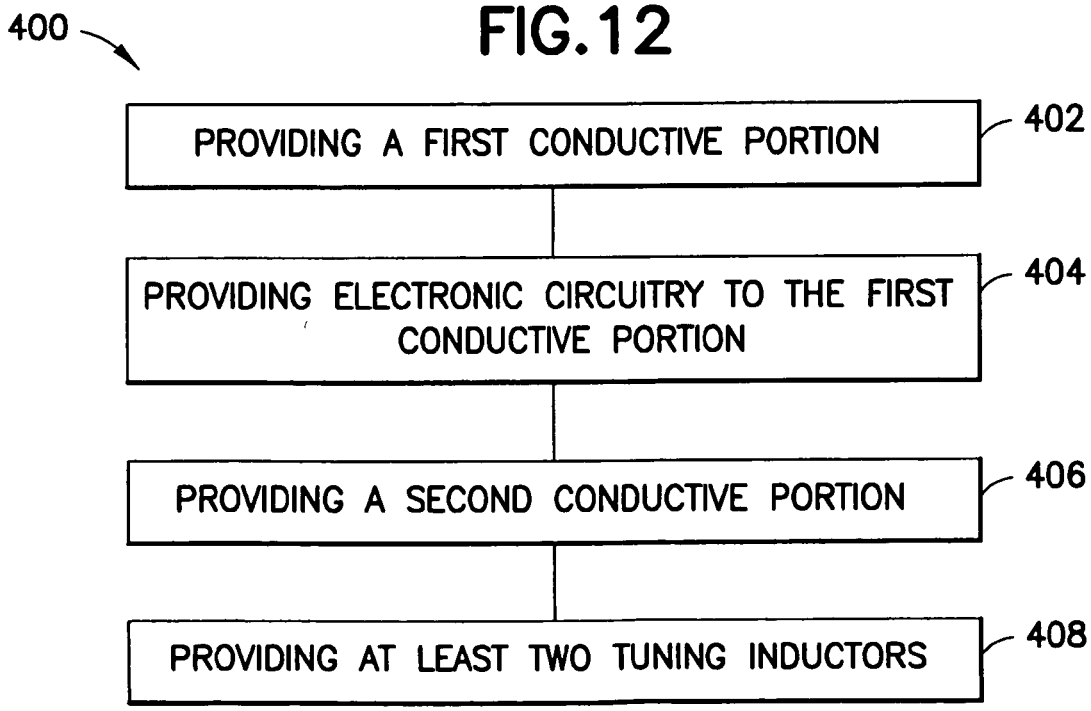
FIG. 13 is a block diagram of another exemplary method.

FIG. 13 illustrates a method 400. The method 400 includes providing a first conductive portion, wherein the first conductive portion comprises a first end, a second end, and a first length between the first end and the second end (at block 402). Providing electronic circuitry to the first conductive portion (at block 404). Providing a second conductive portion, wherein the second conductive portion comprises a first end, a second end, and a second length between the first end and the second end of the second conductive portion (at block 406). Providing at least two tuning inductors, wherein the at least two tuning inductors are configured to move an electrical field along the first length and/or the second length (at block 408). It should be noted that the illustration of a particular order of the blocks does not necessarily imply that there is a required or preferred order for the blocks and the order and arrangement of the blocks may be varied. Furthermore it may be possible for some blocks to be omitted.

It should be noted that although various embodiments of the invention have been described with reference to the rear cover of the device, any other suitable portion of the device may comprise the antenna portion, such as a front or side housing section, for example. In addition, any suitable ground plane may be provided, for example, using a part which is not associated with a printed wiring board, for example a conductive object or combination of inter-connected conductive objects within the portable electronic device.

Additionally, it should further be noted that according to various exemplary embodiments of the invention, the components and the associated FM integrated circuit (IC) may be implemented on the main PWB. However, according to some embodiments of the invention, the components and associated FM IC may be implemented on the cover or any part supporting the antenna arrangement. In one example embodiment, the FM IC(s) or modules may be surface mounted to the main PWB. In other example embodiments, the inductors and capacitors (which are part of the overall antenna arrangement) may be provided on or off the antenna parts, for example, the inductors and/or capacitors may be soldered to the cover (wherein the cover may be metallised plastic). Additionally, the inductor and/or capacitors may also be soldered to the main PWB with conductive parts making contact with the rear cover 26 (for example, wherein contact parts comprise spring contacts, pogo pins, or any other suitable configuration).

The technical effects of any one or more of the exemplary embodiments of the invention provide for a galvanically fed cover as a radiator for a conductive cover FMTx antenna having improved radiation efficiency and isolation between the FMTx antenna and other antennas, as conventional configurations generally result in strong couplings between the FMTx antenna and cellular antennas and other non-cellular antennas due to the higher order modes in the FMTx antenna, which can significantly deteriorate the cellular antennas' and non-cellular antennas' performance.

Additional technical advantages/effects of various exemplary embodiments of the invention provide for implementing an FMTx function in devices having conductive covers and/or housings (such as a conductive cover, for example), as conventional configurations having conductive/metallic covers (or covers coated with conductive material) generally result in low radiation efficiency (and/or deteriorated performance) for an FMTx antenna due to the antenna being covered/blocked by the conductive cover.

Further technical effects of any one or more of the exemplary embodiments provide significant improvements over conventional configurations having an FMTx loop antenna structure by using at least two parts of the portable electronic device as an efficient low frequency (sub-500 MHz) planar loop (e-field) antenna radiator with minimal components. For example various exemplary embodiments of the invention include the cover, the ground plane and a second inductor between the second end of the cover and the ground plane (the first and second inductors for moving the high e-field along the length of the cover and/or ground plane to enable a high efficiency e-field type antenna radiator), the cover, the ground plane and the first and second inductors together providing a full wavelength loop radiator.

Additionally, the technical advantages/effects of any one or more of the exemplary embodiments of the invention allow for unwanted resonances to be tuned away from the cellular and non-cellular bands, and for reduced antenna part cost, as the conductive cover itself is the FMTx antenna. However, it should be noted that ESD protection may be slightly weak, as the conductive cover is grounded through a series inductor.

According to one example of the invention, an apparatus is disclosed. The apparatus includes a cover, a ground plane, a first inductor, and a second inductor. The cover includes a first end and an opposite second end. The cover is configured to operate as a first loop radiator portion. The ground plane is proximate the cover. The ground plane is configured to operate as a second loop radiator portion. The first inductor is proximate the first end of the cover. The second inductor is between the second end of the cover and the ground plane. The cover, the ground plane, and the first and second inductors are configured to provide a loop radiator.

According to another example of the invention, an apparatus is disclosed. The apparatus includes a first conductive portion, a second conductive portion, and at least two tuning inductors. The first conductive portion includes a first end, a second end, and a first length between the first end and the second end. The first conductive portion further includes at least a portion of a loop antenna structure. The second conductive portion includes a first end, a second end, and a second length between the first end and the second end of the second conductive portion. The portion of the loop antenna structure is connected between the at least two tuning inductors. The at least two tuning inductors are configured to move an electrical field along the first length and/or the second length.

While various embodiments of the invention have been described in connection with a planar loop antenna, one skilled in the art will appreciate that embodiments of the invention are not necessarily so limited and that according to some embodiments, the antenna may comprise a non-planar loop antenna. Additionally, any other suitable loop antenna type, independent of circumferential wavelength (halfwave, fullwave, for example) may be provided. Further, it should be understood that various embodiments of the antenna arrangement may be deployed in any type of portable electronic device (such as a monoblock, fold, slide, or wristwatch device).

It should further be noted that the various embodiments of the rear cover, as described above, which provide configurations for operating as a loop radiator, or loop radiator portion may comprise any suitable electrical length. For example, according to some embodiments of the invention, the cover may be configured to operate as half wavelength loop radiator. However, according to other exemplary embodiments of the invention, this may not necessarily be "half wavelength" long, and may be much less than half a wavelength long. For example, exemplary embodiments may comprise any suitable electrical length which is less than the optimum length for an efficient radiator (wherein the sum of the electrical lengths of the cover, ground plane and inductors provides the overall electrical length).

As used in this application, the term 'circuitry' refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory (ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

It should be understood that components of the invention can be operationally coupled or connected and that any number or combination of intervening elements can exist (including no intervening elements). The connections can be direct or indirect and additionally there can merely be a functional relationship between components.

It should also be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An apparatus comprising:

a cover comprising a first end and an opposite second end, wherein the cover is configured to operate as a first loop radiator portion;

a ground plane proximate the cover, wherein the ground plane is configured to operate as a second loop radiator portion;

a first inductor proximate the first end of the cover; and a second inductor between the second end of the cover and the ground plane;

wherein the cover, the ground plane, the first inductor, and the second inductor are configured to provide a loop radiator.

2. An apparatus as in claim 1 wherein at least a portion of the cover is fabricated from metal.

3. An apparatus as in claim 1 wherein the ground plane further comprises a printed wiring board.

4. An apparatus as in claim 1 wherein the cover comprises a first corner, a second corner, a third corner, and a fourth corner, wherein the first and the second corners are at the first end, wherein the third and the fourth corners are at the second end, and wherein the cover is grounded at each of the first, second, third, and fourth corners.

5. An apparatus as in claim 1 wherein the first inductor and the second inductor are configured to move an electrical field along a length of the cover and/or the ground plane to provide a high efficiency e-field type antenna radiator.

6. An apparatus as in claim 1 wherein the cover, the ground plane, the first inductor, and the second inductor are configured to provide a full wavelength loop radiator.

7. An apparatus as in claim 1 wherein the apparatus comprises a portable electronic device.

8. An apparatus comprising:

a first conductive portion comprising a first end, a second end, and a first length between the first end and the second end, wherein the first conductive portion further comprises at least a portion of a loop antenna structure;

a second conductive portion comprising a first end, a second end, and a second length between the first end and the second end of the second conductive portion; and at least two tuning inductors, wherein the portion of the loop antenna structure is connected between the at least two tuning inductors, and wherein the at least two tuning inductors are configured to move an electrical field along the first length and/or the second length;

wherein the first conductive portion comprises a conductive cover, and wherein the second conductive portion comprises a printed wiring board.

9. An apparatus as in claim 8 further comprising an RF component between the first conductive portion and the second conductive portion, and wherein the RF component is configured to filter frequencies outside of an operating frequency of the loop antenna structure.

10. An apparatus as in claim 8 wherein the antenna structure comprises a planar loop.

11. An apparatus as in claim 8 wherein the antenna structure comprises a non-planar loop.

12. A method comprising;

providing a cover having a first end and an opposite second end;

providing transmitter and/or receiver circuitry to the cover, wherein the cover is configured to operate as a first loop radiator portion;

providing a ground plane proximate the cover, wherein the ground plane is configured to operate as a second loop radiator portion;

providing a first inductor proximate the first end of the cover; and providing a second inductor between the second end of the cover and the ground plane;

wherein the cover, the ground plane, the first inductor, and the second inductor are configured to provide a loop radiator.

13. A method as in claim 12 further comprising providing at least one capacitor between the cover and the ground plane.

14. A method as in claim 12 wherein the first inductor and the second inductor are configured to shift an electrical field distribution along the loop radiator.

15. A method as in claim 12 wherein the first inductor and the second inductor further comprise lumped and/or microstrip components.

16. A method comprising:

providing a first conductive portion, wherein the first conductive portion comprises a first end, a second end, and a first length between the first end and the second end;

providing electronic circuitry to the first conductive portion;

providing a second conductive portion, wherein the second conductive portion comprises a first end, a second end, and a second length between the first end and the second end of the second conductive portion; and providing at least two tuning inductors, wherein the at least two tuning inductors are configured to move an electrical field along the first length and/or the second length;

wherein the providing of the first conductive portion further comprises providing a conductive cover of an apparatus, and wherein the providing of the second conductive portion further comprises providing a printed wiring board of an apparatus.

17. A method as in claim 16 wherein the electronic circuitry comprises transmitter and/or receiver circuitry.

18. A method as in claim 17 further comprising providing an RF component between the first conductive portion and the second conductive portion, and wherein the RF component is configured to filter frequencies outside of an operating frequency of the transmitter and/or receiver circuitry.

* * * * *